US010317179B2

(12) United States Patent
Lutzenberger

(10) Patent No.: US 10,317,179 B2
(45) Date of Patent: Jun. 11, 2019

(54) FOLDING WING FOR A MISSILE AND A MISSILE HAVING AT LEAST ONE FOLDING WING ARRANGED THEREON

(71) Applicant: MBDA Deutschland GmbH, Schrobenhausen (DE)

(72) Inventor: Jörg Lutzenberger, Augsburg (DE)

(73) Assignee: MBDA DEUTSCHLAND GMBH, Schrobenhausen (DE)

( * ) Notice: Subject to any disclaimer, the term of this patent is extended or adjusted under 35 U.S.C. 154(b) by 270 days.

(21) Appl. No.: 15/344,072

(22) Filed: Nov. 4, 2016

(65) Prior Publication Data

US 2017/0131075 A1 May 11, 2017

(30) Foreign Application Priority Data

Nov. 6, 2015 (DE) ..... 10 2015 014 367

(51) Int. Cl.
*F42B 10/16* (2006.01)
*F42B 10/14* (2006.01)

(52) U.S. Cl.
CPC ..... *F42B 10/16* (2013.01); *F42B 10/14* (2013.01)

(58) Field of Classification Search
CPC ..... F42B 10/16; F42B 10/18; F42B 10/64
USPC ... 403/67, 81, 111, 112, 116, 150, 151, 164, 403/165
See application file for complete search history.

(56) References Cited

U.S. PATENT DOCUMENTS 3,125,956 A * 3/1964 Kongelbeck ..... F42B 10/16 244/3.29
3,273,500 A * 9/1966 Kongelbeck ..... F42B 10/16 244/3.28
3,650,496 A * 3/1972 Svensson ..... F42B 10/16 244/3.29

(Continued)

FOREIGN PATENT DOCUMENTS

EP 1 855 076 B1 11/2008
EP 2 083 238 B1 1/2014

(Continued)

OTHER PUBLICATIONS

European Patent Office, European Search Report for European Patent Application No. 16197388.8 dated Mar. 30, 2017.

(Continued)

*Primary Examiner* — Brian M O'Hara
*Assistant Examiner* — Christopher D Hutchens
(74) *Attorney, Agent, or Firm* — Lorenz & Kopf LLP

(57) ABSTRACT

A folding wing comprises a wing root, an upper wing part foldable relative to the wing root, at least one guiding device, and an elastically pre-stressed force element. The upper wing part comprises an end edge and a profile foot, wherein the wing root comprises a base and an opposing receiving groove, which is designed to receive the profile foot in a flush manner and is delimited by two delimiting edges having a separation distance that at least equals the maximum profile thickness of the profile foot. The guiding device is arranged at one of the upper wing part and the wing root and is designed for guiding the profile foot in a variable distance to the ground of the receiving groove. The force element is coupled with the wing root and the upper wing part and urges the upper wing part into the receiving groove through the pre-stress.

8 Claims, 3 Drawing Sheets

(56) References Cited

U.S. PATENT DOCUMENTS

| | | | | |
|---|---|---|---|---|
| 3,964,696 | A * | 6/1976 | Orzechowski | F42B 10/16 244/3.23 |
| 4,296,895 | A * | 10/1981 | Paznnany | F42B 10/64 102/388 |
| 4,588,146 | A | 5/1986 | Schaeffel et al. | |
| 4,778,127 | A * | 10/1988 | Duchesneau | F42B 10/16 188/284 |
| 2010/0282895 | A1 * | 11/2010 | Geswender | F42B 10/14 244/3.29 |

FOREIGN PATENT DOCUMENTS

| | | | |
|---|---|---|---|
| FR | 929040 | A | 12/1947 |
| WO | 2009107126 | A1 | 9/2009 |

OTHER PUBLICATIONS

German Patent Office, German Office Action for German Patent Application No. 10 2015 014 368.9 dated Jun. 23, 2016.

* cited by examiner

FOLDING WING FOR A MISSILE AND A MISSILE HAVING AT LEAST ONE FOLDING WING ARRANGED THEREON

CROSS-REFERENCE TO RELATED APPLICATION

This application claims priority to German Patent Application No. 10 2015 014 367.0, filed Nov. 6, 2015, which is incorporated herein by reference in its entirety.

TECHNICAL FIELD

This relates to a folding wing for a missile as well as a missile having at least one folding wing arranged thereon.

BACKGROUND

For a space saving storage of missiles in a launching device, it is often designed in a way that an interior space created therein only receives missiles having folded away wings or stabilizer fins. After launch of the missiles, its wings shall unfold or move into a use position, respectively.

In the prior art, a number of different folding wings are known. For example, EP 2 083 238 B1 shows a folding wing having an unfolding device, wherein the folding wing consists of a wing root, an inner wing surface and an outer wing surface, wherein the wing root is connected to a fuselage of the missile through a rotation device. An unfolding of the folding wing is accomplished through a mechanism integrated into the folding wing having pulleys and a pulling cable.

EP 1 855 076 B1 discloses wrapped wings for a missile, which are supported in a region of the outer surface of the missile with their roots and are rotatable around axes that are oriented in flight direction, and reach a working position by means of a drive.

SUMMARY

It is an object of the embodiment to propose a folding wing for a missile, which is mechanically particularly robust, reliable and mechanically simple at the same time, and which is adaptable to different missiles easily.

This object is met by a folding wing for a missile having the features of independent claim 1. Advantageous improvements and embodiments can be derived from the sub-claims and the following description.

A folding wing for a missile is proposed, comprising a wing root, an upper wing part foldable relative to the wing root, at least one guiding device, and an elastically pre-stressed force element. The foldable upper wing part comprises an end edge and a profile foot. The wing root comprises a base and a receiving groove opposite thereto, which receiving groove is designed corresponding to the profile foot at least in a ground of the groove for receiving the profile foot in a flush manner and is delimited by two delimiting edges, which comprise a distance to each other, which at least equals the maximum profile thickness of the profile foot. The at least one guiding device is arranged at one of the upper wing part and the wing root and is designed for guiding the profile foot in a variable distance to the ground of the receiving groove. The elastically pre-stressed force element is coupled with the wing root and the upper wing part and urges the upper wing part into the receiving groove through the pre-stress.

The wing root of the folding wing is an inner part of the folding wing, which is connected to the fuselage of the missile or constitutes an integral part thereof. The wing root comprises a base having a base contour and/or a resting surface, which connects to the fuselage in a flush manner. The wing root may be a massive or a hollow component, in which optionally reinforcing structures are arranged. Cable ducts may run through the wing root, such that the folding wing may additionally take over the function of cable guiding or covering. In general, different materials may be used, with which a wing root may be manufactured through different manufacturing processes. The manufacturing methods may include machining methods, casting or die casting methods, non-machining forming methods and 3D-printing including SLM methods, as well as precision extrusion.

The foldable upper wing part is to be considered an outer wing surface and together with the wing root creates a full wing in a folded out state. The shape of the upper wing part should therefore connect to the shape of the wing root in a flush manner when the profile foot flushly lies in the receiving groove. A gap between both wing parts that arises due to the folding function and that lies parallel to the flight direction of the missile is tolerable in case the groove and the profile foot of the upper wing part are designed with parallel flanks. Such a gap does not arise with a pairing of profile foot and groove having conically shaped flanks. The profile foot may designed to be either vaulted or at least partially angular. The profile foot of the upper wing part should be designed and equipped with a vault in such a way that no collision or rubbing during the swiveling in into the groove of the wing root occurs.

The special feature of the folding wing according to the embodiment lies in a mechanically simple, yet reliable and light-weight design of a folding mechanism. The receiving groove is dimensioned such that in a working position the foldable upper wing part is received at least by the ground of the groove in a flush manner, in which the folding wing is folded out. Due to the lever relations immanent to the geometry an additional securing device is not necessary, which prevents an unfolding of the wing during the flight. The profile foot cannot be released from the receiving groove after an unfolding without further ado. Particularly, this cannot be accomplished through rolling of a surface of the upper wing part on one of both delimiting edges, but only through a radial pulling out of the groove, until the rolling is possible in the first place and until the end edge of the upper wing part opposite to the profile foot approaches the wing root radially or the fuselage surface connected to the wing root, respectively. Through choosing a flank angle corresponding to the material friction coefficients and surface roughnesses a self-locking may be achieved after a full opening or unfolding of the wing. In case the profile foot comprises a particularly continuous curvature, which may exemplarily be equal to a constant curvature radius, the profile foot may support itself on both delimiting edges during a folding/swiveling motion, wherein during the folding motion, the profile foot is smoothly guided into or out of the receiving groove.

The elastically pre-stressed force element serves for providing a force onto the profile foot, such that it is always urged into the receiving groove. Through dimensioning the distance between the delimiting edges and particularly the shaping of the receiving groove, a permanent tendency for erecting the upper wing part is achieved. The position, linkage and type of pre-stressed force element is neglectable at first, since both pressing the profile foot into the receiving groove and pulling the profile foot into the receiving groove may lead to the desired result.

The elastically pre-stressed force element may exemplarily be a compression spring, a rod spring (bending rod), a tension spring, an elastic tension belt, exemplarily from a rubber-like material, a tension cable having a tension spring arranged thereon or combinations thereof. Through the elastic tensioning, which is expressed as a length change of the force element in an elastic range and thereby includes pulling or compressing, a permanent force action onto the upper wing part can be provided.

For specifying a possible motion path of the upper wing part and hence a limitation of the degree of freedom of the upper wing part for increasing the reliability of the guided motion of the profile foot into the receiving groove, the guiding device is provided. Exemplarily, a motion path of the upper wing part relative to the receiving groove is defined, along which the profile foot may move and along which further a free rotation of the upper wing part is accomplished.

To sum up, the elastically pre-stressed force element, the guiding device and the coordinated components of the profile foot and receiving groove act together in such a way, that a particularly simple, reliable and a low-weight folding mechanism for a folding wing of a missile is created, which automatically folds an upper wing part from a folded state into a working position.

In an advantageous embodiment, the at least one guiding device is realized as a linear guide. The linear guide may comprise a mechanically very simple design in form of a guiding body having a running surface, which is realized through a slit, a groove or the like, in which a component connected to the upper wing part or the wing root is guided. Through aligning the running surface of the linear guide in a substantially radial direction, the elastically pre-stressed force element can act onto the upper wing part with a least possible path length for its motion.

Particularly advantageous the at least one guiding device is arranged at at least one outer surface of the wing root, which adjoins the delimiting edges and which runs perpendicular to a plane spanned up by the delimiting edges. It is furthermore preferred, if at both outer surfaces of the wing root a guiding device is arranged, and an upper wing part is guided without the danger of canting. Since the profile foot slips out of the receiving groove in a folded state of the upper wing part, the at least one guiding device should extend beyond the height of the wing root.

It is convenient if the profile foot comprises a protruding engagement body at each of two opposite lateral surfaces, which engagement body is engageable with the at least one guiding device. The engagement bodies may include spigots, pins, the ends of a continuous axle or similar, and extend through slits of the at least one guiding device or run in groves of the guiding devices. Through the action of the elastically pre-stressed force element, the profile foot may easily be linearly guided along the at least one guiding device. A protruding engagement body may comprise a securing element for preventing a slipping-out particularly in case of using a guiding device having a slit, which securing element is positionable at the end of the engagement body. As an alternative, the engagement body may comprise a web, a step for another suitable shape feature, which acts together with a corresponding shape feature of the guiding device.

The elastically pre-stressed force element may particularly be at least one elastic tensioning element, which is mechanically coupled with the wing root and the engagement bodies of the profile foot (at the same time). Exemplarily, at each lateral surface of the wing root at least one receiving device for receiving an elastical tensioning element may be arranged, wherein the elastical tensioning element extends from the receiving device to the respective protrusion. In this case, the elastical tensioning element may be realized as a belt-type element, as a tension spring or as a tension cable in combination with a tension spring.

In a further advantageous embodiment the pre-stressed force element may at least partially be realized in a belt-like manner and extends through at least one through-opening from one lateral surface of the wing root to an opposite lateral surface of the wing root, and is coupled with the profile foot in the region of both lateral surfaces. In particular it suggests itself to use a tensioning element having a closed circumference, at which two end loops are formed, and each of these is laid around one engagement body, and at which two intermediate belt sections are guided through one or two through-opening(s) of the wing root. Through the pre-stress the tensioning element aims at shortening itself, such that a tension force acts onto the engagement bodies and such that the profile foot is urged into the receiving groove.

In an advantageous embodiment, the receiving groove comprises at least partially conical flanks, which are designed for guiding the upper wing part in the receiving groove of the wing root without play or for clamping it. When dimensioning the measures of the receiving groove it has to be taken care in this case that respective flank angles and friction factors are chosen in a way that the folding wing cannot unlock under an occurring transverse load.

The embodiment furthermore relates to a missile having a fuselage and at least one folding wing arranged thereon, and described above.

BRIEF DESCRIPTION OF THE DRAWINGS

Further characteristics, advantages and potential applications of the present embodiment result from the following description of the exemplary embodiments and the figures. In this respect, all described and/or graphically illustrated characteristics also form the object of the embodiment individually and in arbitrary combination regardless of their composition in the individual claims or their references to other claims. Furthermore, identical or similar objects are identified by the same reference symbols in the figures

DETAILED DESCRIPTION

Figure 1A:
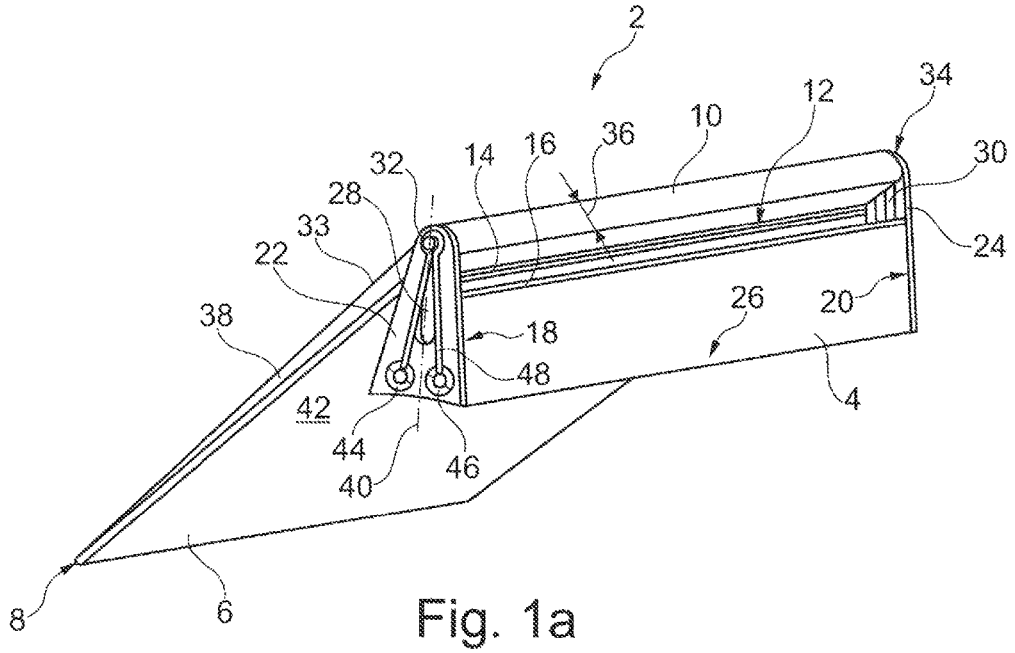
FIG. 1*a* shows a first exemplary embodiment of a folding wing in an isometric view.

FIG. 1*a* shows an isometric illustration of a folding wing 2 having a wing root 4 and an upper wing part 6 foldable thereto, which comprises an end edge 8 facing away from the wing root 4, and a profile foot 10 exemplarily continuously vaulted. The wing root 4 comprises a receiving groove 12, which is arranged between two delimiting edges 14 and 16, and is designed corresponding to the profile foot 10 at least in a ground 13 of the groove. At lateral surfaces 18 and 20, which lie perpendicular to a plane spanned up by the delimiting edges 14 and 16 and run between the delimiting edges 14 and 16, guiding devices 22 and 24 are arranged. These define a motion path perpendicular to a base 26 of the wing root 4, and therefore radial to a fuselage (not shown) connecting to the base 26. Along the motion paths, which exemplarily result through slits 28 and 30 running perpendicular to the base 26, engagement bodies 32 and 34 of the profile foot 10 are guided, which exemplarily protrude perpendicular to a lateral surface 33 each.

A clearance between the delimiting edges 14 and 16 equals at least the maximum profile thickness 36 of the profile foot 10, such that the profile foot 10 may enter the receiving groove 12 from an exterior through the delimiting edges 14 and 16 and may also be pulled out of it again.

FIG. 1*a* shows the upper wing part 6 in a folded-away state in which the missile carrying the folding wing 2 is storable in a space-saving manner. In this state, the skeleton line 38 of the upper wing part 6 is arranged in an angle to a skeleton line 40 of the wing root 4. The profile foot 10 does not lie in the receiving groove 12 then, instead a surface 42 of the upper wing part 6 rests on the delimiting edge 14.

Exemplarily, the wing root 4 comprises two through-openings in form of continuous boreholes 44 and 46, through which a tensioning element 48, exemplarily in the form of a cable, extends and is guided through the engagement bodies 32 and 34. In the interior of the wing root 4 pre-stressed force elements in the form of springs connected with the tensioning element 48 may be present, which pull the engagement body 32 along the slit 40 to the receiving groove 12, such that the profile foot 10 is urged into it. Thus, the upper wing part 6 "rolls" over the delimiting edge 14 into the receiving groove 12, such that the upper wing part is erected progressively, until its skeleton line 38 continuously merges with the skeleton line 40 of the wing root 4.

Figure 1B:
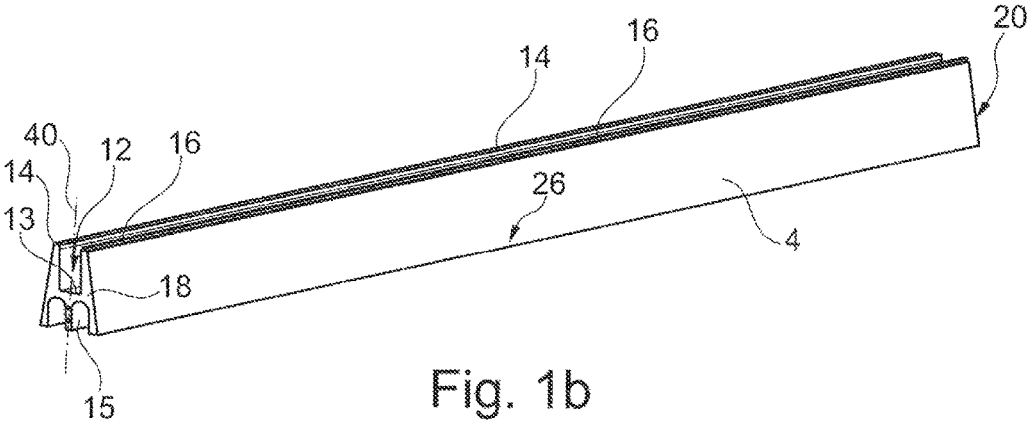
FIG. 1*b* shows an exemplary embodiment of the wing root in an isometric view.

FIG. 1*b* shows a wing root 4, which is exemplarily realized as a single component, which may exemplarily be manufactured by precision extrusion and comprises a stiffening rib 15 underneath the ground of the grove 13. The profile visible at the lateral surface 18 may continuously extend over the whole wing root 4. The space underneath the ground 13 of the groove lateral to the stiffening rib 15 may inter alia serve as a cable duct. The guiding devices 22 and 24, which are exemplarily realized sheet-metal-like and correspond to the profile cross-section of the lateral surfaces 18 and 20, may be arranged on the wing root 4 through glueing, welding, screwing or other force-, form- or material-fit connection methods.

Figure 2:
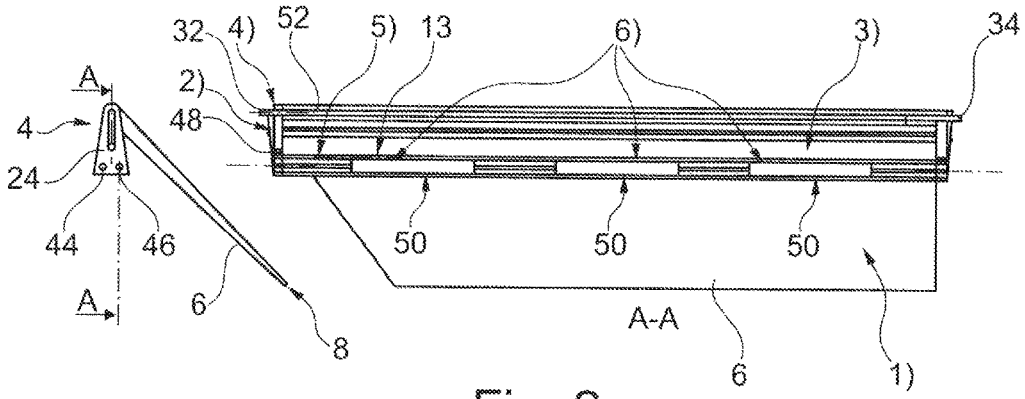
FIG. 2 shows the beginning movement of an upper wing part during the unfolding process.

FIG. 2 shows a sectional view, in which in particular tension springs 50 are visible, which are connected to the tensioning element 48. The engagement bodies 32 may also be ends of a continuous axle 52, which is protected through securing pins, flanges or the like (not shown) from slipping out. Should the space underneath the ground of the grove 13 not serve as a cable duct, an arrangement of the tension belt 48 as well as the tension spring 50 may be realized there.

Figure 3:
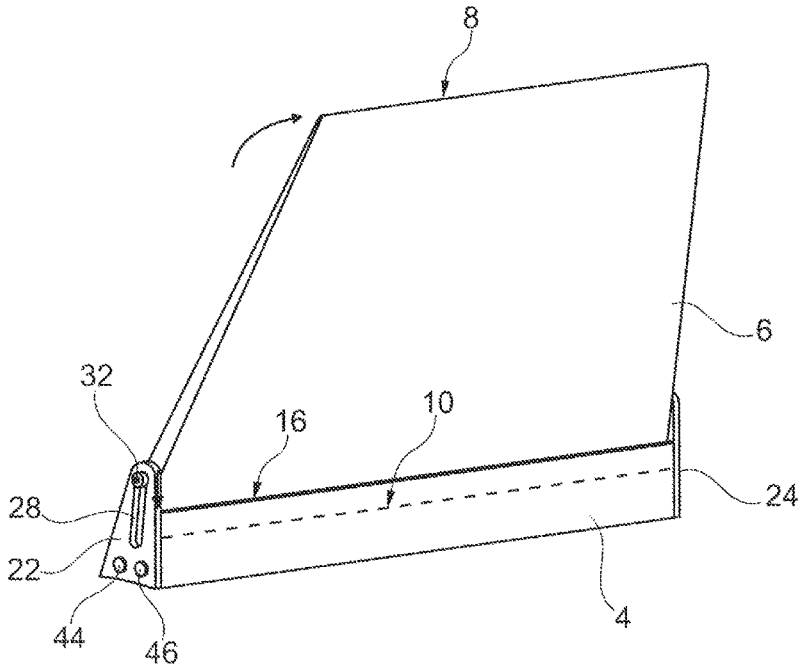
FIG. 3 shows the folding wing of FIGS. 1 and 2 in a sectional view.

In FIG. 3 the process of erecting the upper wing part 6 is shown merely schematically, in which the engagement body 32 is pulled into the direction of the base 26, resulting in the profile foot being moved in the receiving groove 12. Thereby a form-fit connection is accomplished progressively, which is held through a permanent action of force of the tension belt 48.

Figure 4A:
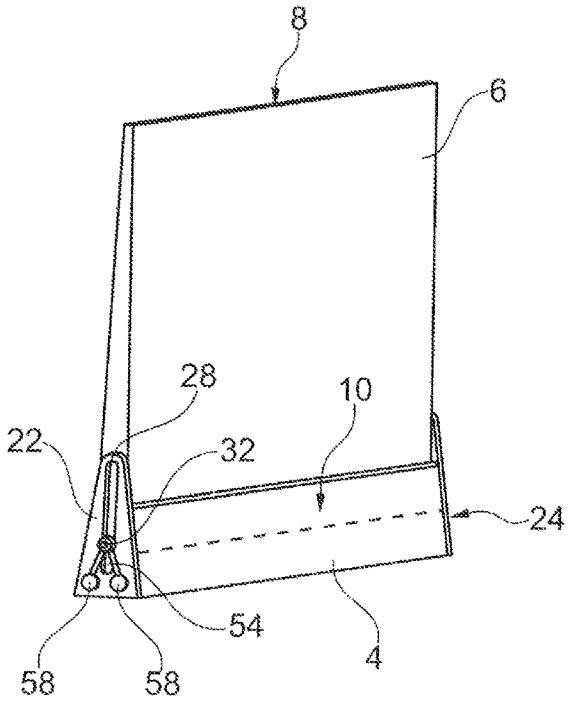
FIGS. 4*a* and 4*b* show alternative force elements.
Figure 4B:
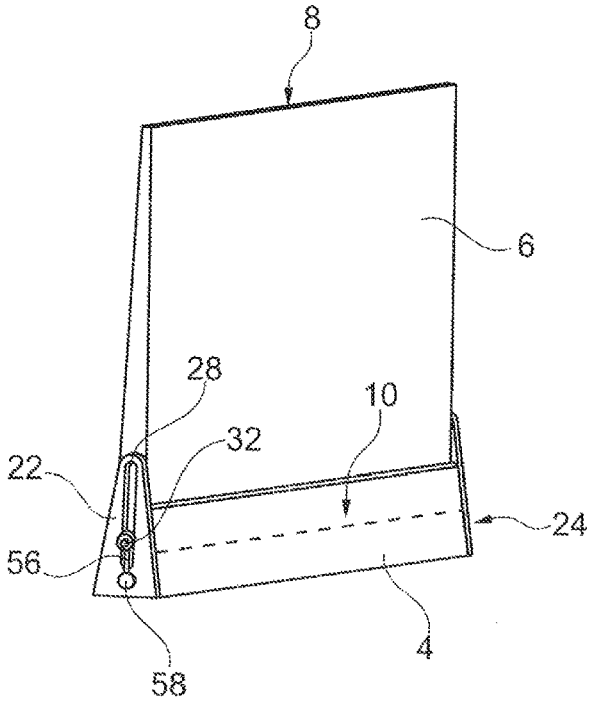

FIGS. 4*a* and 4*b* show a modification with directly acting tensioning elements 54 (FIG. 4*a*) and 56 (FIG. 4*b*), wherein depending on the distance between receiving points 58 and protrusions 32 a different number of tensioning elements 54 would be usable. This may be realized particularly in case a sufficient installation space at the outer side of the wing root 4 is present.

In addition, it should be pointed out that "comprising" does not exclude other elements or steps, and "a" or "an" does not exclude a plural number. Furthermore, it should be pointed out that characteristics or steps which have been described with reference to one of the above exemplary embodiments may also be used in combination with other characteristics or steps of other exemplary embodiments described above. Reference characters in the claims are not to be interpreted as limitations While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the embodiment in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the embodiment as set forth in the appended claims and their legal equivalents.

What is claimed is:

1. A folding wing for a missile, comprising:

a wing root, an upper wing part foldable relative to the wing root, at least one guiding device, and an elastically pre-stressed force element, wherein the foldable upper wing part comprises an end edge and a profile foot, wherein the wing root comprises a base and a receiving groove opposite to the base, which receiving groove is designed corresponding to the profile foot at least in a ground of the groove for receiving the profile foot in a flush manner and is delimited by two delimiting edges, which comprise a distance to each other, which at least equals the maximum profile thickness of the profile foot, wherein the at least one guiding device is arranged at one of the upper wing part and the wing root and is designed for guiding the profile foot in a variable distance to the ground of the receiving groove, wherein the elastically pre-stressed force element is coupled with the wing root and the upper wing part and urges the upper wing part into the receiving groove through the pre-stress, and wherein the pre-stressed force element is a belt-type element that extends through at least one through-opening from one lateral surface of the wing root to an opposite lateral surface of the wing root, and is coupled with the profile foot in the region of both lateral surfaces.

2. The folding wing of claim 1, wherein the at least one guiding device is a linear guide.

3. The folding wing of claim 1, wherein the at least one guiding device is arranged at outer surfaces of the wing root, which enclose the delimiting edges between each other.

4. The folding wing of claim 1, wherein the pre-stressed force element comprises at least one elastical tension element.

5. The folding wing of claim 1, wherein the profile foot comprises a protruding engagement body at each of two opposite lateral surfaces, which engagement body is engageable with the at least one guiding device.

6. The folding wing of claim 5, wherein the pre-stressed force element is mechanically coupled with the wing root and the engagement bodies of the profile foot at the same time.

7. The folding wing of claim 1, wherein the receiving groove comprises flanks, which are designed for guiding the upper wing part in the receiving groove of the wing root without play or for clamping the upper wing part.

8. A missile comprising a fuselage and the folding wing of claim 1.

* * * * *